US007925175B2

(12) United States Patent
Mabuchi

(10) Patent No.: US 7,925,175 B2
(45) Date of Patent: Apr. 12, 2011

(54) DEVELOPING DEVICE AND IMAGE FORMING APPARATUS INCLUDING THE SAME

(75) Inventor: Sayo Mabuchi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/711,832

(22) Filed: Feb. 24, 2010

(65) Prior Publication Data

US 2010/0272457 A1 Oct. 28, 2010

(30) Foreign Application Priority Data

Apr. 28, 2009 (JP) ..... 2009-108630

(51) Int. Cl.
*G03G 15/00* (2006.01)

(52) U.S. Cl. ..... 399/49; 399/58

(58) Field of Classification Search ..... 399/27–29, 399/38, 46, 49, 58–60, 72
See application file for complete search history.

(56) References Cited

U.S. PATENT DOCUMENTS

| | | | | |
|---|---|---|---|---|
| 5,057,870 | A | 10/1991 | Aoki | |
| 7,603,046 | B2 * | 10/2009 | Hirayama | 399/27 |
| 7,751,730 | B2 * | 7/2010 | Kato et al. | 399/30 |
| 7,881,629 | B2 * | 2/2011 | Takeuchi et al. | 399/59 |

FOREIGN PATENT DOCUMENTS

JP 02-050183 2/1990

* cited by examiner

*Primary Examiner* — Hoan Tran
(74) *Attorney, Agent, or Firm* — McDonnell Boehnen Hulbert & Berghoff LLP

(57) ABSTRACT

A developing device includes a developer container storing a developer, a developer supplying member supplying a toner stored in the developer container to an image bearing member, a voltage applying unit capable of applying a bias voltage to the developer supplying member, an image density detecting unit detecting a density of toner formed on the image bearing member, and a control unit correcting a toner concentration in the developer on the basis of a result of image density detection of a reference toner image formed on the image bearing member. The control unit is capable of executing a first toner concentration correction between printing operations and executing a second toner concentration correction between predetermined points during continuous printing.

20 Claims, 11 Drawing Sheets

DEVELOPING DEVICE AND IMAGE FORMING APPARATUS INCLUDING THE SAME

INCORPORATION BY REFERENCE

This application is based upon and claims the benefit of priority from the corresponding Japanese Patent application No. 2009-108630, filed Apr. 28, 2009, the entire contents of which are incorporated herein by reference.

BACKGROUND OF THE INVENTION

1. Field of the Invention

The present invention relates to a developing device included in an image forming apparatus, such as a copier, a facsimile, and a printer, and further relates to an image forming apparatus including the developing device. In particular, the present invention relates to toner concentration control in a developing device that uses a two-component developer containing a magnetic carrier and a toner to develop an electrostatic latent image on an image bearing member.

2. Description of the Related Art

Typical dry-toner developing methods for electrophotographic image forming apparatuses use a one-component developing method or a two-component developing method. The one-component developing method uses no carrier, while the two-component developing method uses a two-component developer in which a magnetic carrier is used to charge a non-magnetic toner. In the two-component developing method, an electrostatic latent image on an image bearing member (photosensitive member) is developed by a magnetic brush of a toner and a carrier formed on a developing roller.

The one-component developing method is suitable for forming high-quality images in that an electrostatic latent image on the image bearing member is not disturbed by the magnetic brush. However, since toner is charged by a charging roller and the thickness of a toner layer on the developing roller is controlled by an elastic control blade, toner additives adhere to the charging roller. This degrades the charging capability of the charging roller and makes it difficult to maintain a constant amount of charged toner. Moreover, adhesion of toner to the control blade may cause an uneven layer to be formed and may result in defective images.

Color printing, which involves superimposition of different colors, requires color toners to be transparent. This means that the color toners need to be non-magnetic toners, since known magnetic toners are not sufficiently transparent. Therefore, full-color image forming apparatuses typically adopt the two-component developing method in which carriers are used to charge and convey toners. The two-component developing method can maintain a constant amount of charged toner over a long time, and is suitable for realizing a longer toner life. However, the two-component developing method may be disadvantageous in that the magnetic brush described above may affect image quality.

As a means for solving the problems described above, in one known developing method, when a developer is moved by a magnetic roller (toner supplying member) onto a developing roller (toner bearing member) that is not in contact with an image bearing member, only a non-magnetic toner is transferred onto the developing roller to form a thin toner layer thereon, with a magnetic carrier remaining on the magnetic roller. Then, an alternating electric field causes the toner to adhere to an electrostatic latent image on the image bearing member.

Toner concentration in a developer may be controlled by adjusting the amount of toner supply depending on a toner concentration detected by a magnetic permeability sensor, etc., or it may be controlled by forming a patch image (reference toner image) to adjust the amount of toner supply on the basis of a detected density of the patch image. However, during continuous printing, image density of a patch image decreases with time. Therefore, if the amount of toner supply is increased in response to the decrease in image density, the toner may be supplied excessively and an image defect, such as fogging, may result.

One known method uses a toner concentration detector that detects a toner concentration in a developer, and an image density detector that optically detects a density of a test pattern (patch image) formed on an image bearing member. In this method, when a toner concentration detected by the toner concentration detector reaches a predetermined upper limit of a toner concentration, toner supply is stopped. Thus, even when a charge potential, exposure, and developer on a photosensitive drum change with time, it is possible to prevent changes in image density.

However, in the method described above, toner concentration control is performed by switching from control based on the result of image density detection to control based on the result of toner concentration detection, according to the size of the patch image. Thus, this method does not prevent image density of a reference toner image from decreasing over time during continuous printing.

During continuous printing, there is a tendency in which toner gradually adheres to a developing roller surface and an electric charge accumulates on the developing roller surface. When an electric charge gradually accumulates on the developing roller surface over time until saturation is reached, the potential of the developing roller surface increases and a direct-current potential difference (effective potential) between the developing roller and a magnetic roller decreases.

Thus, in the two-component developing method described above, the amount of toner supplied from the magnetic roller to the developing roller during continuous printing may decrease with time, and the image density may decrease accordingly. This results in a decrease in the amount of toner supplied to a patch image, affects the detected image density of the patch image, and further affects the toner concentration correction.

When, on the basis of a patch image, a toner concentration correction is performed between printing operations and between predetermined points during continuous printing, the density of the patch image in the toner concentration correction performed during continuous printing is lower than that in the toner concentration correction performed between printing operations. This is because an image density of the patch image decreases with time during continuous printing, which will result in an error in toner concentration correction.

SUMMARY OF THE INVENTION

In view of the problems described above, an object of the present invention is to provide a developing device capable of preventing a decrease in image density during continuous printing, and an image forming apparatus including the developing device.

To achieve the object described above, a developing device according to a first aspect of the present invention includes a developer container configured to store a developer comprising a carrier and a toner; a developer supplying member configured to supply the toner stored in the developer container to an image bearing member; a voltage applying unit capable of applying a bias voltage to the developer supplying member; an image density detecting unit configured to detect a density of toner formed on the image bearing member; and a control unit configured to correct a toner concentration in the developer on the basis of a result of image density detection of a reference toner image formed on the image bearing member. The control unit is capable of executing a first toner concentration correction between printing operations and a second toner concentration correction between predetermined points during continuous printing. The first toner concentration correction involves applying a predetermined reference-toner-image formation bias voltage to the developer supplying member so as to form the reference toner image, the reference-toner-image formation bias voltage being a voltage for forming the reference toner image. The second toner concentration correction involves applying the reference-toner-image formation bias voltage and a correction bias voltage to the developer supplying member so as to form the reference toner image.

With the developing device according to the first aspect of the present invention, it is possible to effectively prevent a decrease in image density during continuous printing, and thus to prevent occurrence of defective images.

An image forming apparatus according to a second aspect of the present invention includes the developing device according to the first aspect of the present invention.

With the image forming apparatus according to the second aspect of the present invention, it is possible to effectively prevent a decrease in image density during continuous printing, and thus to prevent occurrence of defective images.

Additional features and advantages are described herein, and will be apparent from the following Detailed Description and the figures.

DESCRIPTION OF THE PREFERRED EMBODIMENTS

Hereinafter, embodiments of the present invention will be described with reference to the drawings.

Figure 1:
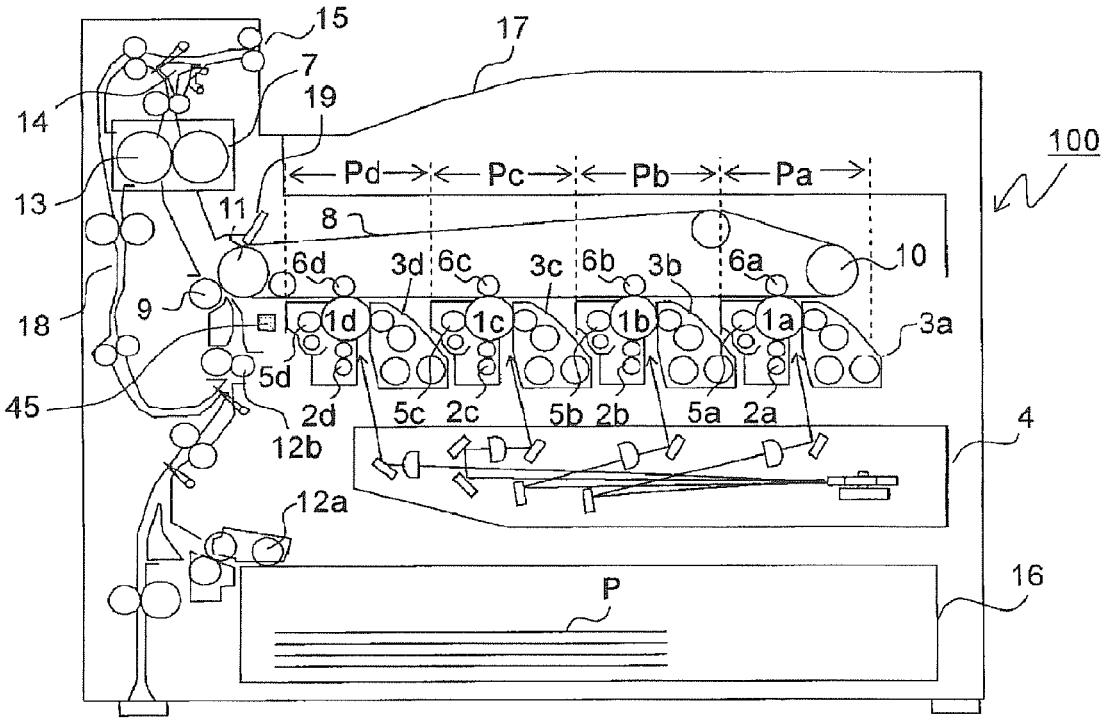
FIG. 1 is a schematic cross-sectional view illustrating an overall configuration of an image forming apparatus including a developing device according to an embodiment of the present invention.

FIG. 1 is a schematic cross-sectional view illustrating an overall configuration of an image forming apparatus including a developing device according to an embodiment of the present invention. In FIG. 1, a tandem color image forming apparatus is shown as an example of the image forming apparatus. In a main body of a color image forming apparatus 100, four image forming parts Pa, Pb, Pc, and Pd are arranged in order upstream from a conveying direction (i.e., from the right side of FIG. 1). The image forming parts Pa, Pb, Pc, and Pd correspond to images of four different colors (cyan, magenta, yellow, and black), respectively, and sequentially form cyan, magenta, yellow, and black images in the process of charging, exposure, development, and transfer.

The image forming parts Pa, Pb, Pc, and Pd include photosensitive drums 1*a*, 1*b*, 1*c*, and 1*d*, respectively, that bear visible images (toner images) of the corresponding colors. An intermediate transfer belt 8 adjacent to the image forming parts Pa, Pb, Pc, and Pd is moved clockwise in FIG. 1 by a driver (not shown). The toner images formed on the photosensitive drums 1*a*, 1*b*, 1*c*, and 1*d* are sequentially transferred onto the moving intermediate transfer belt 8, simultaneously transferred onto a transfer sheet P at a secondary transfer roller 9, fixed onto the transfer sheet P at a fixing part 7, and output from the main body of the color image forming apparatus 100. An image forming process for each of the photosensitive drums 1*a*, 1*b*, 1*c*, and 1*d* is executed while the photosensitive drums 1*a*, 1*b*, 1*c*, and ld are being rotated counterclockwise in FIG. 1.

The transfer sheet P onto which the toner images are transferred is stored in a sheet cassette 16 at the bottom of the color image forming apparatus 100, and conveyed through a feed roller 12*a* and a registration roller pair 12*b* to the secondary transfer roller 9. The intermediate transfer belt 8 is made of a dielectric resin sheet. For example, an endless belt formed by overlapping and joining both ends of the sheet, or a belt having no seam (i.e., a seamless belt) is used as the intermediate transfer belt 8. A blade-like belt cleaner 19 for removing residual toner on the surface of the intermediate transfer belt 8 is disposed downstream of the secondary transfer roller 9.

Next, the image forming parts Pa, Pb, Pc, and Pd will be described. Components provided around and below the photosensitive drums 1*a*, 1*b*, 1*c*, and 1*d* rotatably disposed include chargers 2*a*, 2*b*, 2*c*, and 2*d* that charge the photosensitive drums 1*a*, 1*b*, 1*c*, and 1*d*; an exposure unit 4 that exposes image information to each of the photosensitive drums 1*a*, 1*b*, 1*c*, and 1*d*; developing devices 3*a*, 3*b*, 3*c*, and 3*d* that form toner images on the photosensitive drums 1*a*, 1*b*, 1*c*, and 1*d*; and cleaning parts 5*a*, 5*b*, 5*c*, and 5*d* that remove residual developer (toner) on the photosensitive drums 1*a*, 1*b*, 1*c*, and 1*d*.

When an instruction to start image formation is input by the user, the surfaces of the photosensitive drums 1*a*, 1*b*, 1*c*, and 1*d* are first uniformly charged by the chargers 2*a*, 2*b*, 2*c*, and 2*d* and illuminated by the exposure unit 4. Thus, electrostatic latent images corresponding to image signals are formed on the corresponding photosensitive drums 1*a*, 1*b*, 1*c*, and 1*d*. The developing devices 3*a*, 3*b*, 3*c*, and 3*d* are filled with predetermined amounts of toners of cyan, magenta, yellow, and black, respectively, supplied by a toner supplying device 51 (see FIG. 2). The toners are supplied onto the photosensitive drums 1*a*, 1*b*, 1*c*, and 1*d* by the developing devices 3*a*, 3*b*, 3*c*, and 3*d*, and electrostatically adhere to the photosensitive drums 1*a*, 1*b*, 1*c*, and 1*d*. Thus, toner images corresponding to the electrostatic latent images formed by exposure to light from the exposure unit 4 are formed.

After an electric field is applied to the intermediate transfer belt 8 with a predetermined transfer voltage, the toner images of cyan, magenta, yellow, and black on the photosensitive drums 1*a*, 1*b*, 1*c*, and 1*d* are transferred onto the intermediate transfer belt 8 by intermediate transfer rollers (primary transfer rollers) 6*a*, 6*b*, 6*c*, and 6*d*. The images of the four different colors are formed on the basis of a positional relationship determined in advance for predetermined full-color image formation. In preparation for subsequent formation of other electrostatic latent images, residual toners on the surfaces of the photosensitive drums 1*a*, 1*b*, 1*c*, and 1*d* are removed by the cleaning parts 5*a*, 5*b*, 5*c*, and 5*d*.

The intermediate transfer belt 8 is stretched between a conveying roller 10 disposed upstream and a driving roller 11 disposed downstream. When the driving roller 11 is rotated by a driving motor (not shown) and the intermediate transfer belt 8 starts running clockwise, the transfer sheet P is conveyed at predetermined timing from the registration roller pair 12*b* to the secondary transfer roller 9 adjacent to the intermediate transfer belt 8, and a full-color image is transferred to the transfer sheet P. The transfer sheet P (with the toner images transferred thereto) is conveyed to the fixing part 7.

The transfer sheet P conveyed to the fixing part 7 is subjected to heat and pressure by a fixing roller pair 13. Thus, the toner images are fixed to the surface of the transfer sheet P to form a predetermined full-color image. The transfer sheet P with the full-color image thereon is guided to an appropriate conveying direction by a dividing part 14 that divides in a plurality of directions. When an image is to be formed on only one side of the transfer sheet P, the transfer sheet P is directly discharged by a discharging roller 15 to a discharge tray 17.

When images are to be formed on both sides of the transfer sheet P, the transfer sheet P that has passed through the fixing part 7 is guided to a sheet conveying path 18 by the dividing part 14 and conveyed again to the secondary transfer roller 9, with an image surface facing down. Then, the next image formed on the intermediate transfer belt 8 is transferred by the secondary transfer roller 9 to a surface of the transfer sheet P, the surface having no image formed thereon. The transfer sheet P is further conveyed to the fixing part 7, where the toner image is fixed to the transfer sheet P. Then, the transfer sheet P is discharged to the discharge tray 17.

Figure 2:
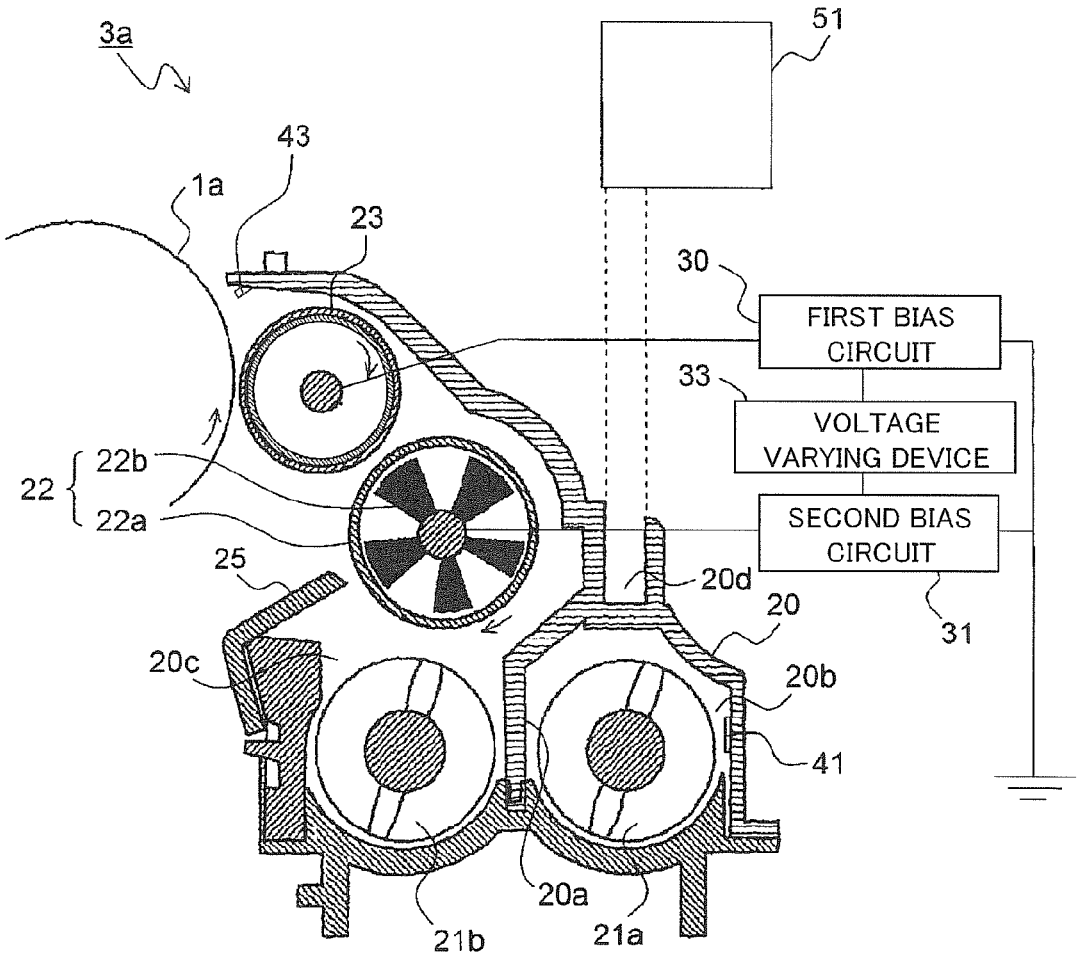
FIG. 2 is a side cross-sectional view illustrating a configuration of a developing device according to the present embodiment.

FIG. 2 is a side cross-sectional view illustrating a configuration of a developing device according to the present embodiment. Here, a description will be given of the developing device 3*a* included in the image forming part Pa illustrated in FIG. 1. The configurations of the developing devices 3*b*, 3*c*, and 3*d* included in the image forming parts Pb, Pc, and Pd, respectively, will not be described here, as they are basically the same as that of the developing device 3*a*.

As illustrated in FIG. 2, the developing device 3*a* includes a developer container 20 that stores a two-component developer (hereinafter simply referred to as developer). The developer container 20 is divided by a partition wall 20*a* into a first stirring chamber 20*b* and a second stirring chamber 20*c*. A first stirring screw 21*a* and a second stirring screw 21*b* are rotatably disposed in the first stirring chamber 20*b* and the second stirring chamber 20*c*, respectively. The first stirring screw 21*a* and the second stirring screw 21*b* stir and mix carrier with toner (positively-charged toner) supplied from the toner supplying device 51 so as to charge the toner.

The developer is axially conveyed while being stirred by the first stirring screw 21*a* and the second stirring screw 21*b*, and circulates between the first stirring chamber 20*b* and the second stirring chamber 20*c* through a developer path (not shown) formed in the partition wall 20*a*. In the illustrated example, the developer container 20 extends obliquely in the upper left direction. In the developer container 20, a magnetic roller 22 is disposed above the second stirring screw 21*b*, and a developing roller 23 is disposed to the upper left of and opposite the magnetic roller 22. The developing roller 23 faces the photosensitive drum 1*a* on an opening side of the developer container 20 (i.e., on the left side of FIG. 2). The magnetic roller 22 and the developing roller 23 rotate clockwise in FIG. 2.

In the developer container 20, a magnetic permeability sensor 41 that detects a toner concentration in the developer is disposed opposite the first stirring screw 21*a*. The magnetic permeability sensor 41 detects the ratio of toner to carrier (toner concentration, T/C) to transmit an output signal to a control unit 39 (see FIG. 4), and thereby detects T/C (result of toner concentration detection).

The magnetic roller 22 includes a non-magnetic rotating sleeve 22*a* and a fixed magnet roller member 22*b* having a plurality of magnetic poles (five poles in this example) contained in the rotating sleeve 22*a*. The developing roller 23 is formed of a non-magnetic developing sleeve. The magnetic roller 22 and the developing roller 23 are disposed opposite each other with a predetermined gap therebetween.

A doctor blade 25 is attached to the developer container 20 along the longitudinal direction of the magnetic roller 22 (i.e., in the direction orthogonal to the plane of FIG. 2). In the rotating direction of the magnetic roller 22 (i.e., in the clockwise direction in FIG. 2), the doctor blade 25 is located upstream of a position at which the developing roller 23 and the magnetic roller 22 face each other. A small gap is created between an end of the doctor blade 25 and the surface of the magnetic roller 22.

A first bias circuit 30 is connected to the developing roller 23, and a second bias circuit 31 is connected to the magnetic roller 22. The first bias circuit 30 applies a direct voltage (hereinafter referred to as Vslv(DC)) and an alternating voltage (hereinafter referred to as Vslv(AC)) to the developing roller 23. The second bias circuit 31 applies a direct voltage (hereinafter referred to as Vmag(DC)) and an alternating voltage (hereinafter referred to as Vmag(AC)) to the magnetic roller 22.

A voltage varying device 33 is connected to both the first bias circuit 30 and the second bias circuit 31. Based on a control signal from the control unit 39 (see FIG. 4), the voltage varying device 33 is capable of varying Vslv(DC) and Vslv(AC) applied to the developing roller 23, and varying Vmag(DC) and Vmag(AC) applied to the magnetic roller 22.

As described above, while being stirred by the first stirring screw 21*a* and the second stirring screw 21*b*, the developer circulates inside the developer container 20 to charge the toner, and is conveyed by the second stirring screw 21*b* to the magnetic roller 22. Then, the developer forms a magnetic brush (not shown) on the magnetic roller 22.

After the layer thickness of the magnetic brush on the magnetic roller 22 is controlled by the doctor blade 25, the magnetic brush is conveyed to a position where the magnetic roller 22 and the developing roller 23 face each other. Then, a thin toner layer is formed on the developing roller 23 by a potential difference (effective potential) between Vmag(DC) applied to the magnetic roller 22 and Vslv(DC) applied to the developing roller 23, and by a magnetic field between the fixed magnet roller member 22*b* and the developing roller 23.

The thickness of the toner layer on the developing roller 23 may vary depending on, for example, the resistance of the developer or a difference in rotation speed between the magnetic roller 22 and the developing roller 23. However, the thickness of the toner layer on the developing roller 23 can be controlled by varying the effective potential between the magnetic roller 22 and the developing roller 23. Hereinafter, the effective potential between the magnetic roller 22 and the developing roller 23 (inter-MS) is referred to as inter-MS DS. The thickness of the toner layer on the developing roller 23 is increased by increasing inter-MS DS, and is reduced by reducing inter-MS DS. Generally, inter-MS DS during the development process is preferably set to be in the 100 V to 350 V range.

Figure 3A:
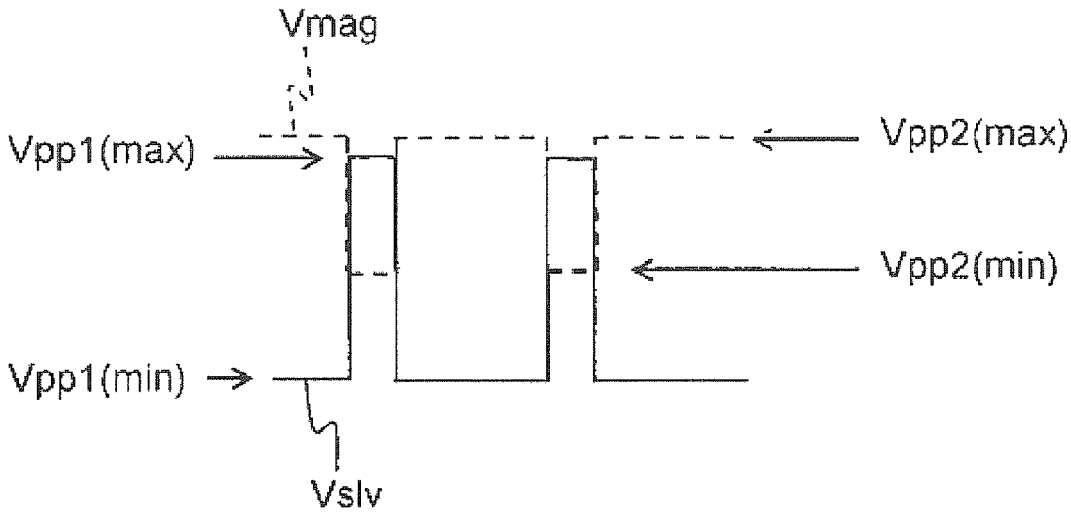
FIGS. 3A and 3B show an example of bias waveforms applied to a developing roller and a magnetic roller.
Figure 3B:
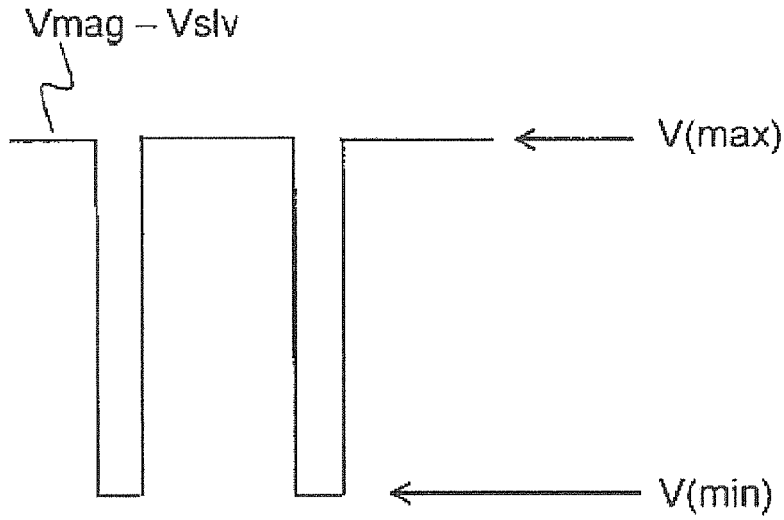

FIGS. 3A and 3B show an example of bias waveforms applied to the developing roller 23 and the magnetic roller 22. As shown in FIG. 3A, a composite waveform Vslv (indicated by a solid line) generated by superimposing Vslv(AC) of a rectangular wave having a peak-to-peak value Vpp1 on Vslv (DC) is applied from the first bias circuit 30 to the developing roller 23. Also as shown in FIG. 3A, a composite waveform Vmag (indicated by a broken line) generated by superimposing Vmag(AC) of a rectangular wave having a peak-to-peak value Vpp2 and differing in phase from Vslv(AC) on Vmag (DC) is applied from the second bias circuit 31 to the magnetic roller 22.

Thus, a voltage applied to inter-MS is that represented by a composite waveform Vmag-Vslv having Vpp(max) and Vpp (min) shown in FIG. 3B. Vmag(AC) is set such that its duty factor is greater than that of Vslv(AC). In practice, the bias waveforms are not perfect rectangular waves such as those shown in FIGS. 3A and 3B. That is, alternating voltages having partially distorted waveforms are applied.

The thin toner layer formed on the developing roller 23 by the magnetic brush is conveyed by rotation of the developing roller 23 to a position where the photosensitive drum 1*a* and the developing roller 23 face each other. Since Vslv(DC) and Vslv(AC) are applied to the developing roller 23, a potential difference between the developing roller 23 and the photosensitive drum 1*a* causes the toner to fly, so that an electrostatic latent image on the photosensitive drum 1*a* is developed.

Residual toner not used in the development process is conveyed to the position where the developing roller 23 and the magnetic roller 22 face each other, and collected by the magnetic brush on the magnetic roller 22. The magnetic brush is peeled off the magnetic roller 22 by the same polar parts of the fixed magnet roller member 22*b*, formed again on the magnetic roller 22 as two-component developer uniformly charged at a proper toner concentration, and conveyed to the doctor blade 25.

In the rotating direction of the photosensitive drums 1*a*, 1*b*, 1*c*, and 1*d*, an image density sensor (image density detecting means) 43 (see FIG. 2) is disposed at a downstream end of each of the developing devices 3*a*, 3*b*, 3*c*, and 3*d*. Each image density sensor 43 is located opposite its corresponding photosensitive drum 1*a*, 1*b*, 1*c*, or 1*d*. The image density sensor 43 is an optical sensor including a light-emitting element, such as a light-emitting diode (LED), and a photodetector, such as a photodiode.

For measuring the amount of toner adhering to the photosensitive drums 1*a*, 1*b*, 1*c*, and 1*d*, when the light-emitting element of the image density sensor 43 emits measurement light to a patch image (reference toner image) formed on its corresponding photosensitive drum 1*a*, 1*b*, 1*c*, or 1*d*, the measurement light is incident on the photodetector of the image density sensor 43 as light reflected by the toner and the drum surface. The patch image formed on each of the photosensitive drums 1*a*, 1*b*, 1*c*, and 1*d* typically is a patch image having a substantially rectangular shape.

If the amount of toner adhesion is large, the light reflected from the drum surface is blocked by the toner and the amount of light received by the photodetector is small. Conversely, if the amount of toner adhesion is small, a large amount of light is reflected from the drum surface and the amount of light received by the photodetector is large. Therefore, by transmitting to the control unit 39 (see FIG. 4) an output value of a light receiving signal based on the amount of light received, an image density TD of a patch image of each color (result of image density detection) can be detected.

The image density sensor 43 may be disposed outside each of the developing devices 3*a*, 3*b*, 3*c*, and 3*d* in the color image forming apparatus 100. For example, in the rotating direction of the photosensitive drums 1*a*, 1*b*, 1*c*, and 1*d*, the image density sensor 43 may be disposed at a position upstream of each of the developing devices 3*a*, 3*b*, 3*c*, and 3*d* and downstream of each of the intermediate transfer rollers 6*a*, 6*b*, 6*c*, and 6*d*.

The image density sensor 43 is also capable of detecting a patch image transferred to the intermediate transfer belt 8. Additionally, if the color image forming apparatus 100 is an image forming apparatus using a direct transfer method in which a patch image formed on each of the photosensitive drums 1*a*, 1*b*, 1*c*, and 1*d* is directly transferred onto the transfer sheet P conveyed by a conveying belt, the image density sensor 43 is capable of detecting the patch image transferred onto the transfer sheet P and the patch image transferred onto the conveying belt.

As illustrated in FIG. 1, a temperature humidity sensor 45 is provided inside the color image forming apparatus 100. The temperature humidity sensor 45 is capable of detecting environmental temperature and humidity (environmental condition) around the developing devices 3*a*, 3*b*, 3*c*, and 3*d* and transmitting an output signal to the control unit 39. The temperature humidity sensor 45 may be disposed on the outer surfaces or inside the developing devices 3*a*, 3*b*, 3*c*, and 3*d*.

Figure 4:
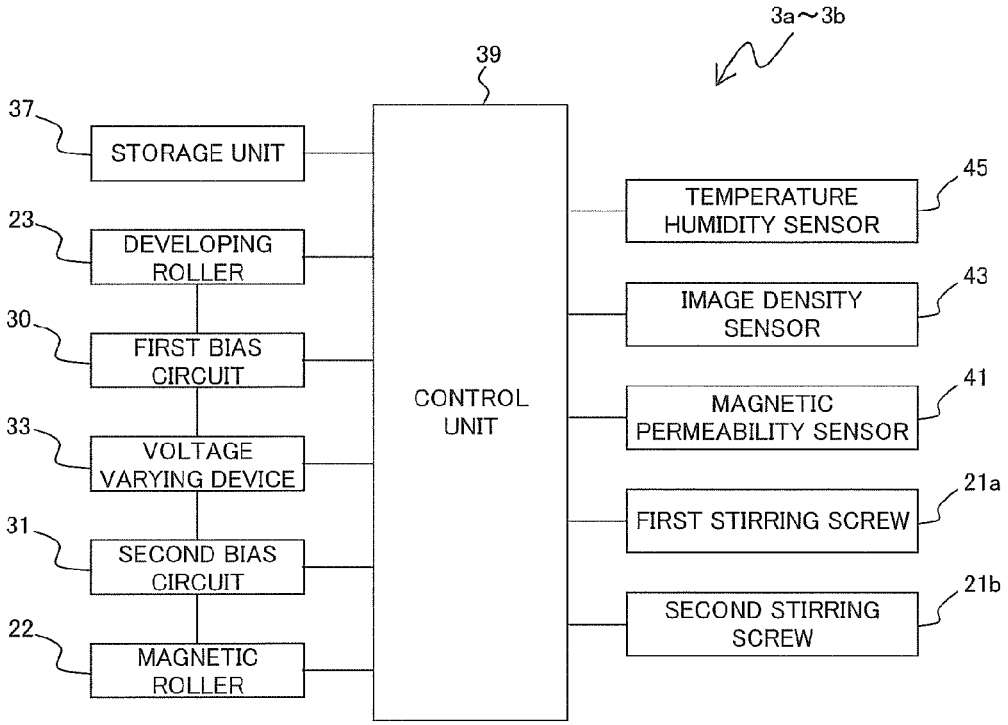
FIG. 4 is a block diagram illustrating a control path of a developing device according to the present embodiment.

FIG. 4 is a block diagram illustrating a control path of a developing device according to the present embodiment. Components common to those illustrated in FIG. 1 and FIG. 2 are given the same reference numerals and their description will be omitted. The developing devices 3*a*, 3*b*, 3*c*, and 3*d* each include the first stirring screw 21*a*, the second stirring screw 21*b*, the magnetic roller 22, the developing roller 23, the first bias circuit 30, the second bias circuit 31, the voltage varying device 33, the magnetic permeability sensor 41, the image density sensor 43, and the temperature humidity sensor 45.

A storage unit 37 is, for example, a readable/writable random-access memory (RAM). The storage unit 37 stores a control program used by the control unit 39 related to stirring and conveyance of developer, and a T/C toner concentration correction parameter for use in a T/C toner concentration correction (described below). The T/C toner concentration correction parameter associates T/C detected by the magnetic permeability sensor 41 with a control voltage Vcon for adjusting the amount of toner supply.

The storage unit 37 also stores a CTD toner concentration correction parameter for use in a CTD toner concentration correction (described below). The CTD toner concentration correction parameter associates an output value of the image density sensor 43 with TD, a color toner density (CTD), and Vcon. The storage unit 37 also stores a predetermined accumulated printing time T1 and a predetermined continuous printing time t1 (described below), and an environmental condition parameter for determining whether a result of temperature humidity detection performed by the temperature humidity sensor 45 satisfies a predetermined environmental condition.

Additionally, the storage unit 37 stores a set value V1 of VslvP(DC) and a set value V2 of VmagP(DC) for forming a first patch image for an inter-job toner concentration correction in the CTD toner concentration correction, and correction biases ΔV such as a first correction bias ΔV1 and a second correction bias ΔV2 to be added to the set value V2 of VmagP (DC) for forming a second patch image for an inter-sheet toner concentration correction in the CTD toner concentration correction.

The control unit 39 is capable of receiving an output signal from the magnetic permeability sensor 41, calculating T/C on the basis of the T/C toner concentration correction parameter stored in the storage unit 37, and adjusting Vcon (T/C toner concentration correction, third toner concentration correction).

When a calibration mode is set, for example, by key operation on an operation panel (not shown), the control unit 39 forms the first patch image, receives an output signal from the image density sensor 43, calculates TD and CTD on the basis of the CTD toner concentration correction parameter stored in the storage unit 37, and adjusts Vcon (inter-job toner concentration correction). The calibration mode can be set when the apparatus is turned on, and between consecutive image forming processes (jobs), each being a process for a predetermined number of sheets.

The control unit 39 is also capable of counting the accumulated printing time T and determining, during continuous printing, whether the predetermined accumulated printing time T1 has been reached. In a mode other than the calibration mode, each time the accumulated printing time T reaches the predetermined accumulated printing time T1, the control unit 39 forms the second patch image, receives an output signal from the image density sensor 43, calculates TD and CTD on the basis of the CTD toner concentration correction parameter, and adjusts Vcon (inter-sheet toner concentration correction).

In the inter-sheet toner concentration correction, the control unit 39 is capable of varying VmagP(DC) from V2 to V2+ΔV1 or V2+ΔV2 to form the second patch image. The accumulated printing time T represents the total amount of time of printing performed on transfer sheets P when one or more jobs have been performed. The accumulated printing time T is reset to zero when the inter-sheet toner concentration correction is performed.

The control unit 39 is capable of measuring a continuous printing time t immediately before the inter-sheet toner concentration correction is performed, and determining whether the continuous printing time t is longer than or equal to the predetermined continuous printing time t1. If the continuous printing time t immediately before the inter-sheet toner concentration correction is performed is longer than or equal to the predetermined continuous printing time t1, the control unit 39 varies VmagP(DC) from V1 to V1+ΔV2. The continuous printing time t represents the amount of time that elapses, when the predetermined accumulated printing time T1 is reached during one continuous printing process (job), i.e., from when printing of the job begins to when printing ends immediately before the inter-sheet toner concentration correction is performed.

The control unit 39 is capable of receiving an output signal from the temperature humidity sensor 45, and determining whether the result of temperature humidity detection satisfies a low-temperature low-humidity condition (e.g., 10° C. or less, 15% relative humidity (RH) or less). If the result of temperature humidity detection satisfies the low-temperature low-humidity condition, the control unit 39 varies VmagP (DC) from V2 to V2+ΔV2. The storage unit 37 and the control unit 39 may also serve as a storage unit and a control unit for the entire color image forming apparatus 100, or may be provided independently for controlling the developing devices 3*a*, 3*b*, 3*c*, and 3*d*.

Next, the T/C toner concentration correction using the magnetic permeability sensor 41 and the CTD toner concentration correction using the image density sensor 43 will be described.

As described above, the control unit 39 calculates T/C on the basis of an output signal from the magnetic permeability sensor 41. Then, based on the calculated T/C, the control unit 39 varies the control voltage Vcon for adjusting the amount of toner supplied from the toner supplying device 51. Thus, the amount of toner supply is adjusted and toner is supplied from the toner supplying device 51 through a toner supply port 20*d* (see FIG. 2) into the developer container 20. By varying the amount of toner supplied to the developing devices 3*a*, 3*b*, 3*c*, and 3*d* (i.e., by varying Vcon) on the basis of the output signal from the magnetic permeability sensor 41, a toner concentration correction based on T/C (i.e., T/C toner concentration correction, third toner concentration correction) is performed for each color.

Also, as described above, the control unit 39 calculates TD and CTD on the basis of an output signal from the image density sensor 43. Then, based on the calculated TD and CTD, the control unit 39 varies Vcon. Thus, the amount of toner supply is adjusted and toner is supplied from the toner supplying device 51 through the toner supply port 20*d* into the developer container 20. By varying the amount of toner supplied to the developing devices 3*a*, 3*b*, 3*c*, and 3*d* (i.e., by varying Vcon) on the basis of the output signal from the image density sensor 43, a toner concentration correction based on CTD (i.e., CTD toner concentration correction, first and second toner concentration corrections) is performed for each color.

Figure 5:
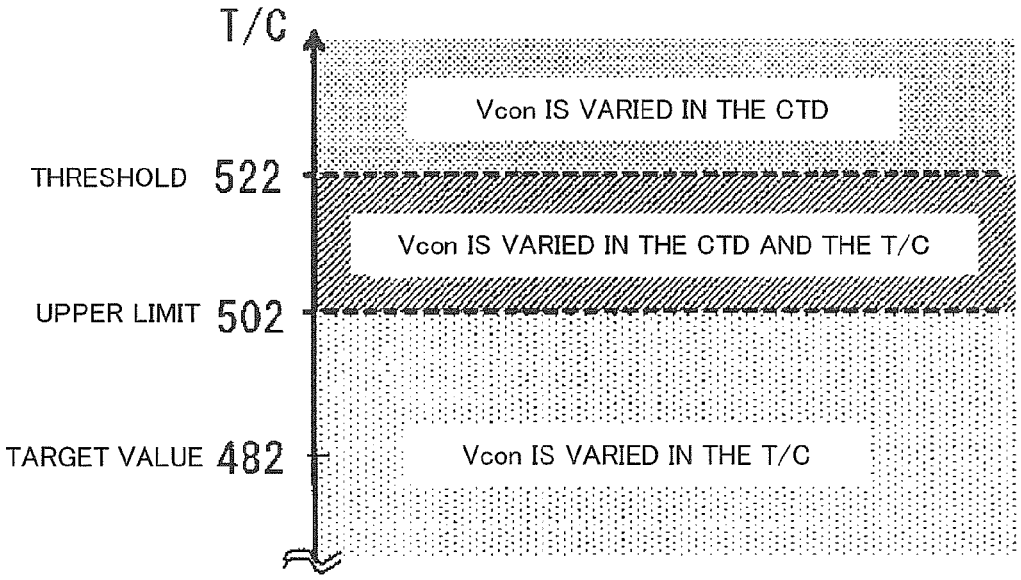
FIG. 5 schematically illustrates the timing of performing T/C and CTD toner concentration corrections.

FIG. 5 schematically illustrates the timing of performing the T/C and CTD toner concentration corrections. Although only the upper side of a T/C target value is shown in FIG. 5, a correction similar to that on the upper side is performed on the lower side. The target value and other numerical values shown in FIG. 5 are merely examples, and may be changed appropriately according to the apparatus configuration, etc.

As shown in FIG. 5, the target value for T/C detected by the magnetic permeability sensor 41 is set to 482. Also, the upper limit of T/C is set to 502, and the threshold of T/C is set to 522. If T/C does not exceed the upper limit 502 (T/C 502), Vcon is varied in the T/C toner concentration correction to adjust T/C to the target value 482.

On the other hand, if T/C exceeds the upper limit 502 (502<T/C), or if T/C exceeds the upper limit 502 but does not exceed the threshold 522 (502<T/C 522), Vcon is varied in the CTD toner concentration correction as well as in the T/C toner concentration correction, such that appropriate adjustment is made. That is, on the basis of T/C from the magnetic permeability sensor 41, Vcon is varied such that T/C is smaller than the upper limit, while on the basis of CTD calculated by the image density sensor 43, Vcon is corrected such that CTD is between the upper and lower limits. More description of CTD will be given later on.

As a result, if T/C becomes smaller than or equal to the upper limit 502, only the T/C toner concentration correction is performed again. On the other hand, if T/C exceeds the threshold 522 (522<T/C), only the CTD toner concentration correction is performed. As a result, if T/C becomes smaller than or equal to the threshold 522, the T/C and CTD toner concentration corrections are performed as described above. Then, if T/C becomes smaller than or equal to the upper limit 502, only the T/C toner concentration correction is performed as described above.

The total amount of variation in Vcon in both the T/C and CTD toner concentration corrections at one time can be set to fall within the range of ±0.26V, while the total amount of variation in Vcon in the CTD toner concentration correction at one time can be set to fall within the range of ±0.31V. Here, 0.82V correspond to the amount of T/C variation of about 1%. The amount of variation in Vcon is not limited to the values described above, and can be set appropriately depending on the apparatus configuration etc.

Next, the CTD toner concentration correction using the image density sensor 43 will be described in detail. In a period between jobs, VslvP(DC) and VmagP(DC) are set to V1 and V2, respectively, to form the first patch image. On the basis of a result of detection of the first patch image by the image density sensor 43 as described above, TD and CTD are calculated to adjust Vcon (inter-job toner concentration correction, first toner concentration correction).

In the present invention, each time the accumulated printing time T reaches the predetermined accumulated printing time T1 in continuous printing, the set value V2 of VmagP (DC) and the correction bias ΔV are applied to the magnetic roller 22 to form the second patch image and perform the inter-sheet toner concentration correction.

That is, each time the accumulated printing time T reaches the predetermined accumulated printing time T1 during a single job, the correction bias ΔV is added to the set value V2 of VmagP(DC), with the set value of VslvP(DC) maintained at V1, to form the second patch image. Then, on the basis of a result of detection of the second patch image by the image density sensor 43 as described above, TD and CTD are calculated to adjust Vcon (inter-sheet toner concentration correction, second toner concentration correction).

Figure 6:
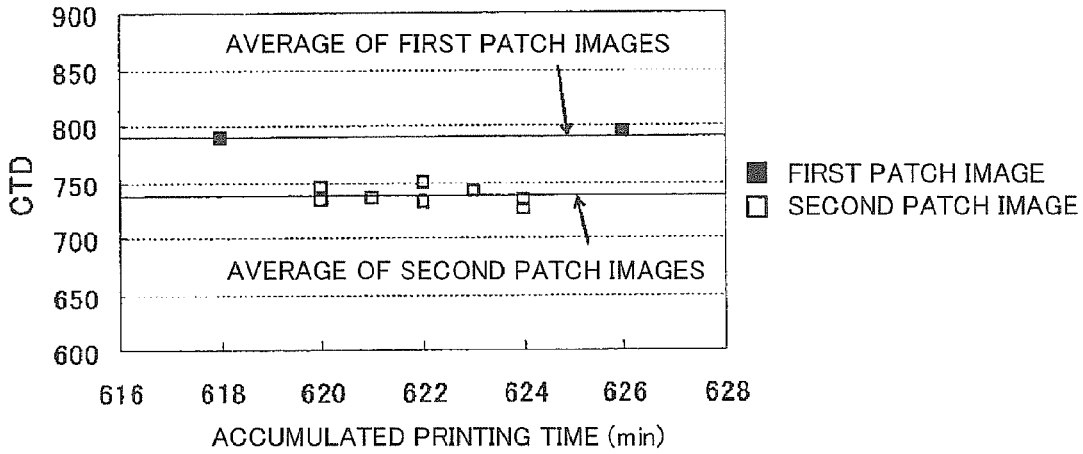
FIG. 6 shows an example, in a black developing device, of CTD based on a first patch image for an inter-job toner concentration correction, and CTD based on a second patch image for an inter-sheet toner concentration correction in which no correction bias is added.
Figure 7:
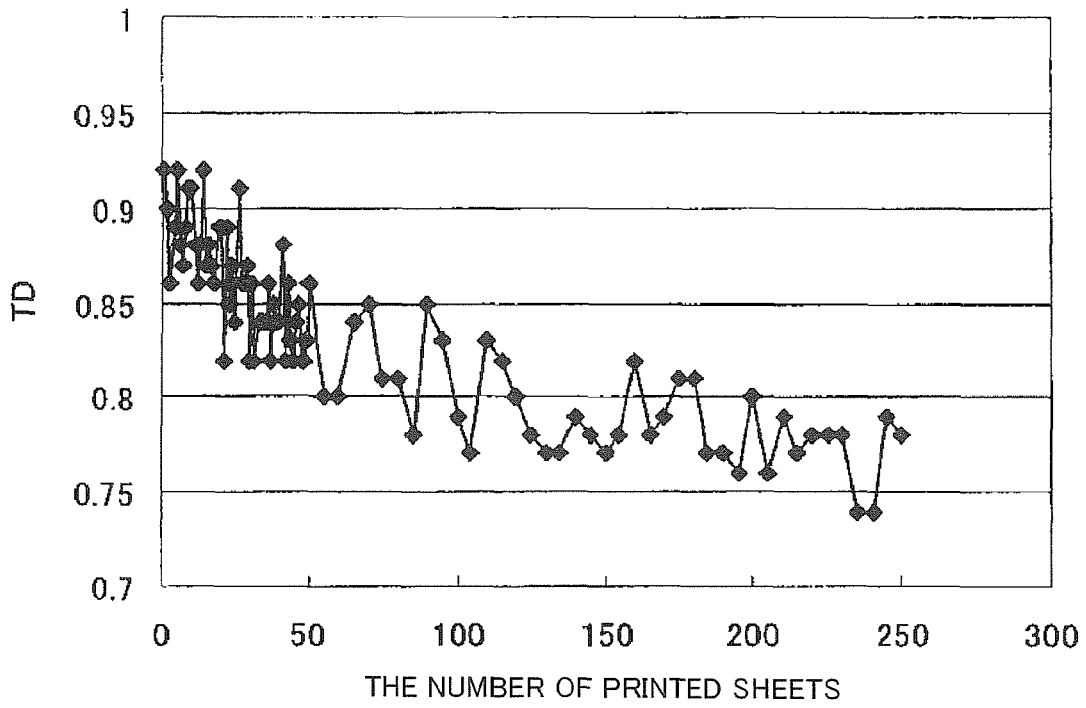
FIG. 7 shows an example of TD of the second patch image for the inter-sheet toner concentration correction in a black developing device.

FIG. 6 shows an example, in a black developing device, of CTD based on the first patch image for the inter-job toner concentration correction, and CTD based on the second patch image for the inter-sheet toner concentration correction in which no correction bias is added. FIG. 7 shows an example of TD of the second patch image for the inter-sheet toner concentration correction in a black developing device.

In FIG. 6, the horizontal axis represents the accumulated printing time T, and the vertical axis represents CTD of the first and second patch images, the CTD being calculated from a result of detection performed by the image density sensor 43. FIG. 6 shows CTD at each time point and an average CTD value.

In FIG. 7, the horizontal axis represents the number of printed sheets to indicate the time that has elapsed since the start of printing, and the vertical axis represents TD of the second patch image, the TD being calculated from a result of detection performed by the image density sensor 43. In FIG. 7, about 30 printed sheets are equivalent to a printing time of about 1 minute, and about 150 printed sheets are equivalent to a printing time of about 5 minutes.

As shown in FIG. 6, CTD of the second patch image for the inter-sheet toner concentration correction is lower than CTD of the first patch image for the inter-job toner concentration correction executed before and after continuous printing. Therefore, adjusting Vcon on the basis of CTD of the second patch image leads to a smaller amount of toner supply. This results in a smaller amount of toner on the developing roller 23 and a lower image density of the second patch image.

As continuous printing proceeds as shown in FIG. 7, an electric charge of, for example, 10 V to 20 V is accumulated on the developing roller 23. Since this increases the potential of the surface layer of the developing roller 23, inter-MS DS decreases as the printing proceeds. Thus, the amount of toner borne on the developing roller 23 decreases by the amount by which inter-MS DS decreases. This results in a lower TD and a lower CTD.

As shown in FIG. 7, TD decreases significantly until about one minute after the start of printing, continues to gradually decrease, and is substantially saturated in about five minutes. That is, in about five minutes, the amount of electric charge accumulated on the developing roller 23 becomes substantially constant at a predetermined voltage. Here, inter-MS DS decreases by about 10 V in about one minute, and decreases by about 20 V in about five minutes.

On the other hand, since Vslv and Vmag applied to the developing roller 23 and the magnetic roller 22, respectively, are temporarily stopped upon completion of printing, the electric charge on the developing roller 23 is emitted. Therefore, at the time of inter-job toner concentration correction, since no electric charge is accumulated on the developing roller 23 and inter-MS DS does not decrease, TD and CTD of the first patch image do not decrease.

As described above, in continuous printing, even if TD and CTD are calculated on the basis of the detection result of the second patch image formed in a state where inter-MS DS decreases and the inter-sheet toner concentration correction is performed, it is difficult to properly adjust the amount of toner supplied to the black developing device 3*d*. Tendencies similar to those shown in FIG. 6 and FIG. 7 are observed for the color developing devices 3*a*, 3*b*, and 3*c*.

Thus, every time the predetermined accumulated printing time T1 is reached, the inter-sheet toner concentration correction is performed, where the correction bias ΔV is added to the set value V2 of VmagP(DC) to form the second patch image. The correction bias ΔV can be set, for example, according to the amount of decrease in inter-MS DS such that inter-MS DS becomes closer to that at the start of continuous printing (i.e., at the time of inter-job toner concentration correction).

As shown in FIG. 7, when the decrease in TD is substantially saturated at about five minutes after the start of printing, the decrease in CTD is also substantially saturated. Therefore, for example, the predetermined accumulated printing time T1 can be set to five minutes, so that the inter-sheet toner concentration correction can be performed every five minutes.

Figure 8:
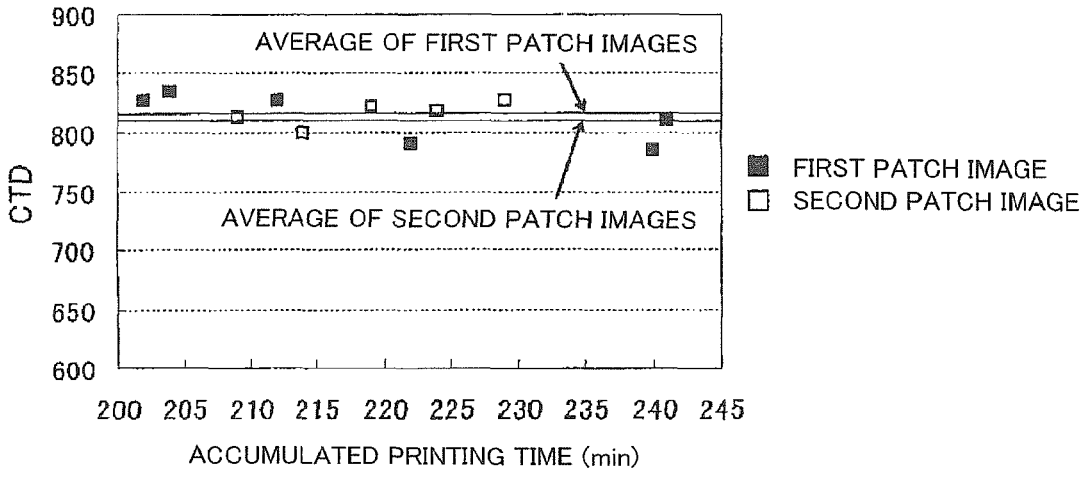
FIG. 8 shows an example, in a black developing device, of CTD based on the first patch image for the inter-job toner concentration correction, and CTD based on the second patch image for the inter-sheet toner concentration correction in which a correction bias is added.

Then, in the black developing device 3*d*, for example, the set value V2 is set to 120 V and the correction bias ΔV is set to the first correction bias ΔV1 (e.g., 20 V) to perform the inter-job toner concentration correction and the inter-sheet toner concentration correction. FIG. 8 shows an example, in a black developing device, of CTD based on the first patch image for the inter-job toner concentration correction, and CTD based on the second patch image for the inter-sheet toner concentration correction in which a correction bias is added.

By changing VmagP(DC) from 120 V to 140 V (120V+20V) in the inter-sheet toner concentration correction, inter-MS DS in the inter-sheet toner concentration correction becomes closer to that in the inter-job toner concentration correction, as shown in FIG. 8. Therefore, it is possible to prevent CTD of the second patch image from decreasing and make it substantially the same as CTD of the first patch image. A result similar to that shown in FIG. 8 can be obtained in the color developing devices 3*a*, 3*b*, and 3*c*.

Next, a description will be given of a first exemplary control for the inter-sheet toner concentration correction performed in a developing device according to the present embodiment. Before the accumulated printing time T reaches the predetermined accumulated printing time T1, if Vslv and Vmag applied to the developing roller 23 and the magnetic roller 22 are stopped between jobs, an electric charge on the developing roller 23 is temporarily dissipated. Then, once continuous printing begins, an electric charge starts to accumulate on the developing roller 23.

Considering this, when the predetermined accumulated printing time T1 is reached and the inter-sheet toner concentration is corrected for a job, the correction bias ΔV can be varied based on the continuous printing time immediately before the inter-sheet toner concentration correction. That is, the time from the start of printing in this job until the end of the printing immediately before the inter-sheet toner concentration correction is performed (i.e., the preceding continuous printing time t) is greater than or equal to the predetermined continuous printing time t1 (e.g., one minute).

That is, if the continuous printing time t is greater than or equal to one minute, a sufficient amount of electric charge is assumed to be accumulated on the developing roller 23. Thus, the first correction bias ΔV1 (e.g., 20 V) is added to the set value V2 (e.g., 120 V) of VmagP(DC) to apply V2+ΔV1 to the magnetic roller 22. On the other hand, if the preceding continuous printing time t is less than one minute, the amount of electric charge accumulated on the developing roller 23 is assumed to be small. Thus, the second correction bias ΔV2 (e.g., 10 V), which is smaller than ΔV1, is added to the set value V2 of VmagP(DC) to apply V2+ΔV2 to the magnetic roller 22.

Figure 9:
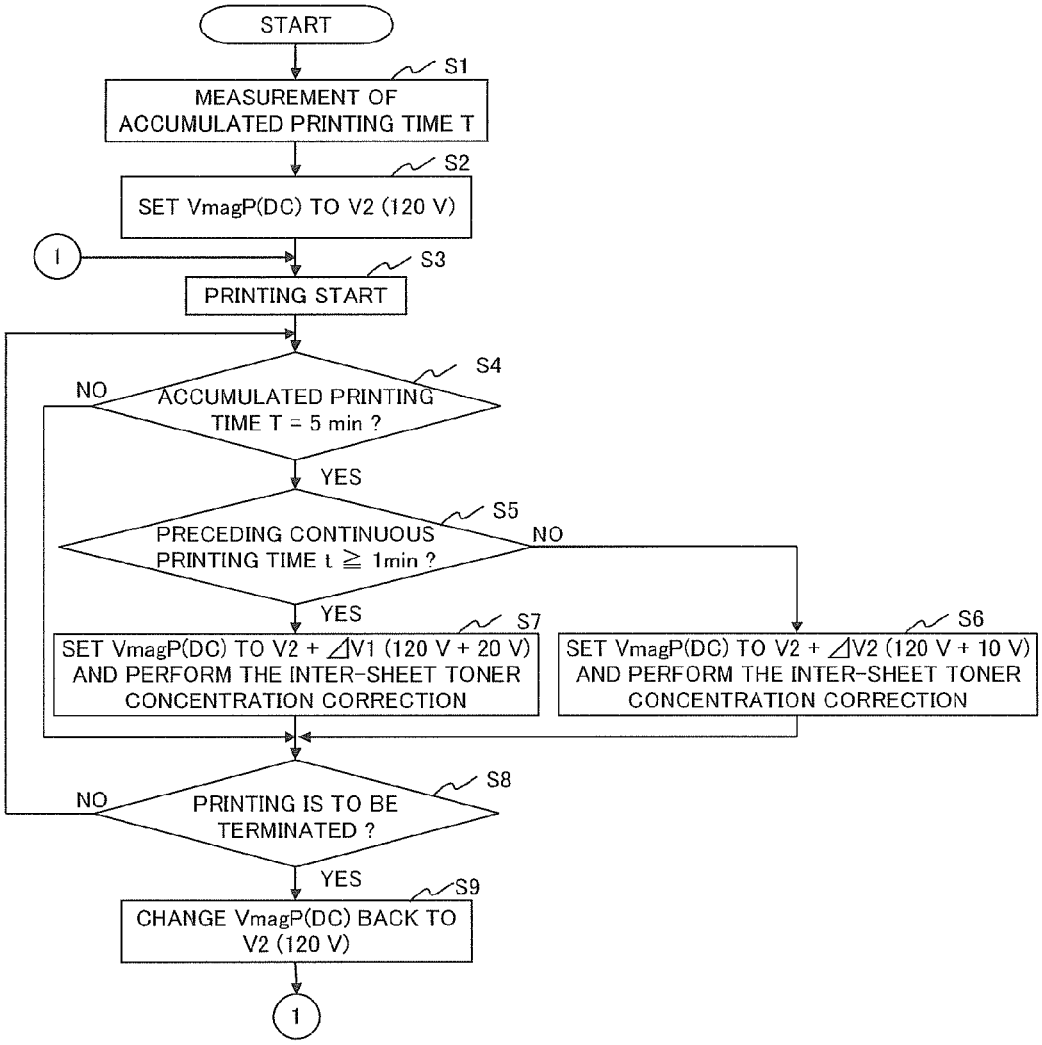
FIG. 9 is a flowchart illustrating a control procedure of first exemplary control performed by a developing device of the present embodiment.

FIG. 9 is a flowchart illustrating a control procedure of the first exemplary control. This flowchart illustrates the inter-sheet toner concentration correction performed in the developing device 3*d*. First, the measurement of the accumulated printing time T starts (step S1), and the set values of VslvP(DC) and VmagP(DC) are set to V1 and V2 (120 V), respectively (step S2). After the quantity of printing, etc. is set and printing starts (step S3), a determination is made as to whether the accumulated printing time T has reached the predetermined accumulated printing time T1 (five minutes in this example) (step S4).

If the accumulated printing time T has reached five minutes (YES in step S4), a determination is made as to whether the preceding continuous printing time t is greater than or equal to the predetermined continuous printing time t1 (one minute in this example) (step S5). If the continuous printing time t is less than one minute (NO in step S5), VmagP(DC) is set to V2+ΔV2 (120 V+10 V) obtained by adding the second correction bias ΔV2 (10 V) to the set value V2 (120 V) to form the second patch image and perform the inter-sheet toner concentration correction (step S6).

On the other hand, if the continuous printing time t is greater than or equal to one minute (YES in step S5), VmagP(DC) is set to V2+ΔV1 (120 V+20 V) obtained by adding the first correction bias ΔV1 (20 V) to the set value V2 (120 V) to form the second patch image and perform the inter-sheet toner concentration correction (step S7). In step S6 and step S7, VslvP(DC) is maintained at the set value V1.

Then, a determination is made as to whether the quantity of printing has reached the level set in step S3, in other words, whether the printing is to be terminated (step S8). If the set quantity has not been reached (NO in step S8), the process returns to step S4 and the operations in step S4 to step S7 are repeated. On the other hand, if the set quantity has been reached (YES in step S8), VmagP(DC) is changed back to the set value V2 (step S9) and the process waits until the next printing operation starts. If it is determined in step S4 that the accumulated printing time T has not reached five minutes (NO in step S4), the process proceeds to step S8 and the above-described operations are performed.

In the first exemplary control described above, by varying the correction bias ΔV on the basis of the continuous printing time t immediately before the inter-sheet toner concentration correction is performed, inter-MS DS can be adjusted according to the amount of toner adhering to the developing roller 23. It is thus possible to appropriately prevent the image density of the second patch image from decreasing.

Figure 10:
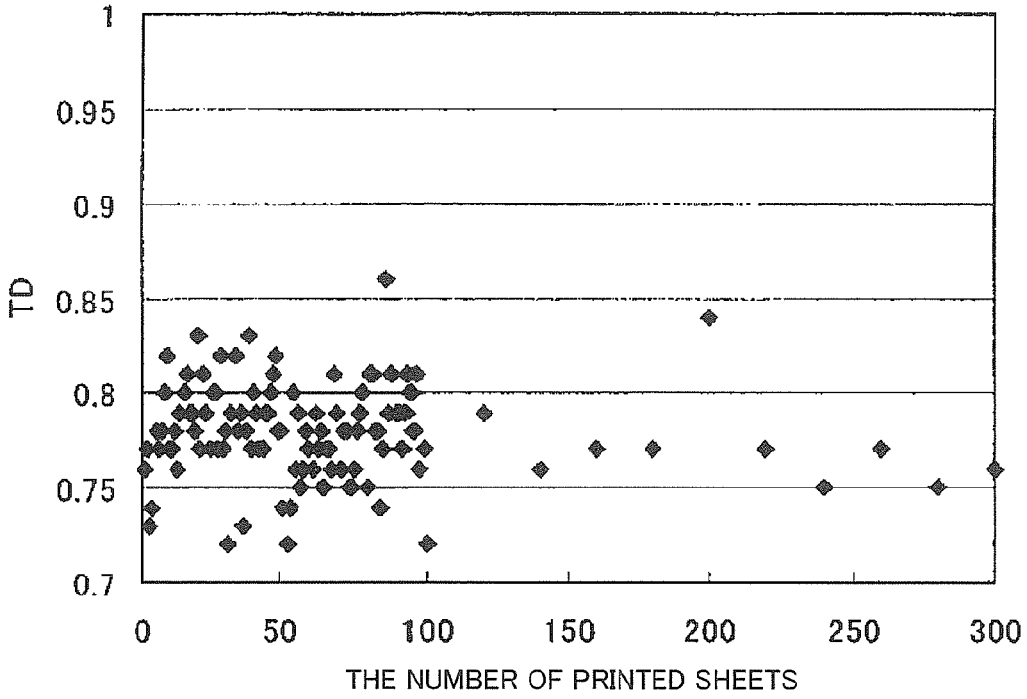
FIG. 10 shows an example of TD of the second patch image for the inter-sheet toner concentration correction performed under a low-temperature low-humidity environmental condition in a black developing device.

Next, a description will be given of a second exemplary control for the inter-sheet toner concentration correction performed in a developing device according to the present embodiment. FIG. 10 shows an example of TD of the second patch image for the inter-sheet toner concentration correction performed under a low-temperature low-humidity environmental condition (e.g., 10° C., 15% RH) in a black developing device. In FIG. 10, as in the case of FIG. 7, about 30 printed sheets are equivalent to a printing time of about 1 minute. In the black developing device 3*d*, the adhesion of toner to the surface of the developing roller 23 varies depending on environmental conditions, such as temperature and humidity. In particular, a low-temperature low-humidity condition, such as 10° C. or less and 15% RH or less, tends to cause static electricity, which can cause toner to easily adhere to the surface of the developing roller 23.

In this case, as shown in FIG. 10, toner starts adhering to the surface of the developing roller 23 immediately after the start of printing. This results in accumulation of an electric charge on the surface of the developing roller 23 and a decrease in inter-MS DS. This causes a decrease in TD, an increase in TD variation, and a decrease in CTD. A tendency similar to that shown in FIG. 10 is observed in the color developing devices 3*a*, 3*b*, and 3*c*.

Thus, if a result of temperature humidity detection performed by the temperature humidity sensor 45 satisfies a low-temperature low-humidity condition (e.g., 10° C. or less, 15% RH or less), VmagP(DC) is set to V2+ΔV1 (120 V+20 V) obtained by adding the first correction bias ΔV1 (20 V) to the set value V2 (120 V), regardless of the continuous printing time t immediately before the inter-sheet toner concentration correction.

Since inter-MS DS can thus be adjusted according to the environmental condition, the image density correction can be performed appropriately. If the result of temperature humidity detection performed by the temperature humidity sensor 45 is over 10° C. and over 15% RH, the correction bias ΔV for VmagP(DC) is set to the first correction bias ΔV1 or the second correction bias ΔV2 depending on the continuous printing time t immediately before the inter-sheet toner concentration correction, as in the case of the first exemplary control described above.

Figure 11:
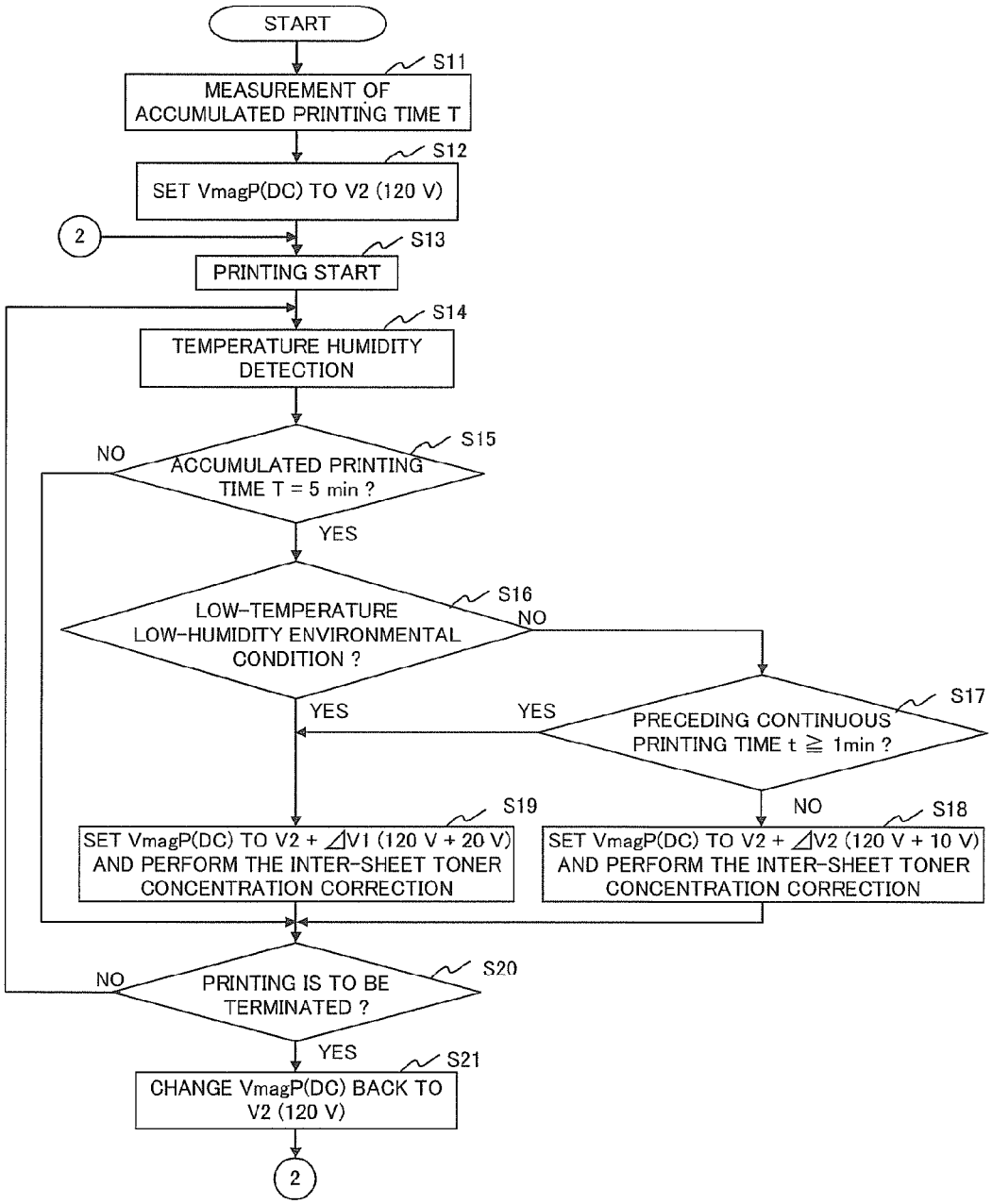
FIG. 11 is a flowchart illustrating a control procedure of second exemplary control performed by a developing device of the present embodiment.

FIG. 11 is a flowchart illustrating a control procedure of the second exemplary control. This flowchart illustrates the inter-sheet toner concentration correction performed in the developing device 3*d*. First, the measurement of the accumulated printing time T starts (step S11), and the set values of VslvP (DC) and VmagP(DC) are set to V1 and V2 (120 V), respectively (step S12). After the quantity of printing etc. are set and printing starts (step S13), temperature humidity detection is performed by the image density sensor 43 (step S14). Then, a determination is made as to whether the accumulated printing time T has reached the predetermined accumulated printing time T1 (five minutes) (step S15).

If the accumulated printing time T has reached five minutes (YES in step S15), a determination is made as to whether the result of the temperature humidity detection performed by the temperature humidity sensor 45 satisfies a low-temperature low-humidity environmental condition (10° C. or less, 15% RH or less) (step S16). If the low-temperature low-humidity environmental condition is not satisfied (NO in step S16), a determination is made as to whether the preceding continuous printing time t is greater than or equal to the predetermined continuous printing time t1 (one minute) (step S17). If the continuous printing time t is less than one minute (NO in step S17), VmagP(DC) is set to V2+ΔV2 (120 V+10 V) obtained by adding the second correction bias ΔV2 (10 V) to the set value V2 (120 V) to form the second patch image and perform the inter-sheet toner concentration correction (step S18).

On the other hand, if the continuous printing time t is greater than or equal to one minute (YES in step S17), VmagP (DC) is set to V2+ΔV1 (120 V+20 V) obtained by adding the first correction bias ΔV1 (20 V) to the set value V2 (120 V) to form the second patch image and perform the inter-sheet toner concentration correction (step S19). If the low-temperature low-humidity environmental condition is satisfied (YES in step S16), the process proceeds to step A19, where the first correction bias ΔV1 (20 V) is added to the set value V2 to perform the inter-sheet toner concentration correction. In step S18 and step S19, VslvP(DC) is maintained at the set value V1.

Then, a determination is made as to whether the quantity of printing has reached the level set in step S13, in other words, whether the printing is to be terminated (step S20). If the set quantity has not been reached (NO in step S20), the process returns to step S14 and the operations in step S14 to step S19 are repeated. On the other hand, if the set quantity has been reached (YES in step S20), VmagP(DC) is changed back to the set value V2 (step S21) and the process waits until the next printing operation starts. If it is determined in step S15 that the accumulated printing time T has not reached five minutes (NO in step S15), the process proceeds to step S20 and the above-described operations are performed.

In the second exemplary control described above, by varying the correction bias ΔV on the basis of the temperature humidity detection performed by the temperature humidity sensor 45, inter-MS DS can be adjusted according to the amount of toner adhering to the developing roller 23. It is thus possible to appropriately prevent the image density of the second patch image from decreasing. If an environmental condition that may cause adhesion of toner to the developing roller 23 is detectable, a temperature humidity condition can be appropriately set. Alternatively, it is possible to separately use a temperature and a humidity detected by a temperature sensor and a humidity sensor, respectively.

The developing device in which the inter-sheet toner concentration correction of the present invention is performed is not specifically limited to the black developing device 3*d* described in the exemplary control above. The same correction can be performed, for example, in the color developing devices 3*a*, 3*b*, and 3*c*. In the color developing devices 3*a*, 3*b*, and 3*c*, for example, the set value V2 of VmagP(DC) can be set to 260 V, and the correction bias ΔV1 and the correction bias ΔV2 can be set to 10 V and 5 V, respectively.

In color printing, VslvP(DC) and VmagP(DC) applied to the developing roller 23 and the magnetic roller 22, respectively, for forming the first and second patch images are set to be twice or more those in black printing. Thus, the permeability of color toner can be prevented from affecting a result of image density detection of the patch images. Therefore, since inter-MS DS can be adjusted according to how the first and second patch images have been formed, it is possible to appropriately prevent the image density of the second patch image from decreasing.

The smaller the amount of toner (toner layer) formed on the developing roller 23 (i.e., the smaller VmagP(DC)), the relatively larger the effect of electric charge accumulated on the developing roller 23 on inter-MS DS during continuous printing. Therefore, in color printing, the effect of electric charge accumulated on the developing roller 23 on inter-MS DS is smaller than that in black printing, so that the first correction bias ΔV1 and the second correction bias ΔV2 can be made about half those in black printing.

Thus, by varying the correction bias ΔV based on the set value V2, it is possible to adjust inter-MS DS according to the effect of toner adhering to the developing roller 23 on inter-MS DS. Therefore, it is possible to appropriately prevent the image density of the patch image from decreasing. The set value V2, the correction bias ΔV, the first correction bias ΔV1, and the second correction bias ΔV2 are not specifically limited to those described above, and can be varied appropriately depending on the decrease in inter-MS DS, the apparatus configuration, or the like.

The upper and lower limits of CTD can be set, for example, to 850 and 775, respectively, in black printing where the set value V2 of VmagP(DC) is 120 V, and to 475 and 425, respectively, in color printing where the set value V2 of VmagP(DC) is 260 V. The upper and lower limits of CTD are not specifically limited to those described above, and can be varied appropriately depending on the state of toner supply, the apparatus configuration, or the like.

In the present embodiment, at least one of the T/C toner concentration correction based on T/C detected by the magnetic permeability sensor 41 and the CTD toner concentration correction based on CTD detected by the image density sensor 43 is performed. This makes it possible to precisely adjust the amount of toner supply. However, it is also possible to perform only the CTD toner concentration correction.

The present invention is not limited to the embodiments described above, and can be changed in various ways without departing from the scope of the present invention. For example, the predetermined accumulated printing time T1, the predetermined continuous printing time t1, and the environmental condition, etc. are not specifically limited to those described above, and can be set appropriately depending on the apparatus configuration, etc. The predetermined accumulated printing time T1 and the predetermined continuous printing time t1 may be represented by the number of printed sheets or the like, as long as it is possible to indicate the printing time.

In the above embodiments, a description has been given, as an example, of a developing method (so-called reverse developing method) in which a positively-charged toner charged in the positive (plus) direction is used to cause the toner to fly toward an exposed portion of the surface of the photosensitive member. The present invention is applicable in the same manner to a developing device using a negatively-charged toner charged in the negative (minus) direction, and to a forward-developing-type developing device configured to cause the toner to fly toward an unexposed portion of the surface of the photosensitive member.

The present invention is applicable not only to the tandem color printer illustrated in FIG. 1, but also to various types of image forming apparatuses that include a developing device. Examples of the image forming apparatuses include a digital or analog monochrome copier, a monochrome printer, a rotary-developing-type color printer and color copier, and a facsimile.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A developing device comprising:

a developer container configured to store a developer containing a carrier and a toner;

a developer supplying member configured to supply the toner stored in the developer container to an image bearing member;

voltage applying means capable of applying a bias voltage to the developer supplying member;

image density detecting means configured to detect a density of toner formed on the image bearing member; and control means configured to correct a toner concentration in the developer on the basis of a result of image density detection of a reference toner image formed on the image bearing member, the image density detection being performed by the image density detecting means, wherein the control means is capable of executing a first toner concentration correction between printing operations and executing a second toner concentration correction between predetermined points during continuous printing;

the first toner concentration correction includes applying a predetermined reference-toner-image formation bias voltage to the developer supplying member so as to form the reference toner image, the reference-toner-image formation bias voltage being a voltage for forming the reference toner image; and the second toner concentration correction includes applying the reference-toner-image formation bias voltage and a correction bias voltage to the developer supplying member so as to form the reference toner image.

2. The developing device according to claim 1, wherein the second toner concentration correction involves, each time a first predetermined condition is reached during the continuous printing, applying the reference-toner-image formation bias voltage and the correction bias voltage to the developer supplying member when forming the reference toner image.

3. The developing device according to claim 2, wherein the first predetermined condition is a predetermined accumulated printing time during the continuous printing or a predetermined accumulated number of sheets printed during the continuous printing.

4. The developing device according to claim 2, wherein after the first predetermined condition is reached during the continuous printing, the control means varies the correction bias voltage according to a second predetermined condition.

5. The developing device according to claim 4, wherein the second predetermined condition is a continuous printing time immediately before the second toner concentration correction is performed, the number of sheets continuously printed immediately before the second toner concentration correction is performed, or an ambient environmental condition.

6. The developing device according to claim 1, wherein the reference-toner-image formation bias voltage for color image formation is at least twice that for black image formation.

7. The developing device according to claim 1, wherein the correction bias voltage for color image formation is about half that for black image formation.

8. The developing device according to claim 1, wherein the control means varies the correction bias voltage based on the reference-toner-image formation bias voltage.

9. The developing device according to claim 1, wherein the developer supplying member includes a toner bearing member for supplying the toner to the image bearing member, and a toner supplying member that forms a toner layer on the toner bearing member by using a magnetic brush; and the reference-toner-image formation bias voltage is applied to the toner supplying member.

10. The developing device according to claim 1, wherein the reference-toner-image formation bias voltage is a direct voltage.

11. The developing device according to claim 1, wherein the voltage applying means is capable of applying a direct bias voltage and an alternating bias voltage to the developer supplying member.

12. The developing device according to claim 1, wherein the developer container is provided with toner concentration detecting means that detects a toner concentration in the developer; and the control means is capable of executing a third toner concentration correction on the basis of a result of toner concentration detection performed by the toner concentration detecting means.

13. The developing device according to claim 12, wherein the control means executes, during the continuous printing, at least one of the second toner concentration correction and the third toner concentration correction on the basis of the result of toner concentration detection performed by the toner concentration detecting means.

14. The developing device according to claim 12, comprising a toner supplying member configured to supply the toner to the developer container, wherein the third toner concentration correction includes adjusting the amount of toner supplied from the toner supplying member.

15. An image forming apparatus having a developing device that comprises:

a developer container configured to store a developer containing a carrier and a toner;

a developer supplying member configured to supply the toner stored in the developer container to an image bearing member;

voltage applying means capable of applying a bias voltage to the developer supplying member;

image density detecting means configured to detect a density of toner formed on the image bearing member; and control means configured to correct a toner concentration in the developer on the basis of a result of image density detection of a reference toner image formed on the image bearing member, the image density detection being performed by the image density detecting means, wherein the control means is capable of executing a first toner concentration correction between printing operations and executing a second toner concentration correction between predetermined points during continuous printing;

the first toner concentration correction includes applying a predetermined reference-toner-image formation bias voltage to the developer supplying member so as to form the reference toner image, the reference-toner-image formation bias voltage being a voltage for forming the reference toner image; and the second toner concentration correction includes applying the reference-toner-image formation bias voltage and a correction bias voltage to the developer supplying member so as to form the reference toner image.

16. The image forming apparatus according to claim 15, wherein the voltage applying means is capable of applying a direct bias voltage and an alternating bias voltage to the developer supplying member, and the reference-toner-image formation bias voltage for color image formation is at least twice that for black image formation.

17. The image forming apparatus according to claim 15, wherein the developer container is provided with toner concentration detecting means that detects a toner concentration in the developer; and the control means is capable of executing a third toner concentration correction on the basis of a result of toner concentration detection performed by the toner concentration detecting means.

18. The image forming apparatus according to claim 17, wherein the control means executes, during the continuous printing, at least one of the second toner concentration correction and the third toner concentration correction on the basis of the result of toner concentration detection performed by the toner concentration detecting means.

19. The image forming apparatus according to claim 17, comprising a toner supplying member configured to supply the toner to the developer container, wherein the third toner concentration correction includes adjusting the amount of toner supplied from the toner supplying member.

20. A method for developing an image in an image forming apparatus, the method comprising:

storing, in a developer container, a developer containing a carrier and a toner;

supplying, in a developer supplying member, the toner stored in the developer container to an image bearing member;

applying, in a voltage applying means, a bias voltage to the developer supplying member;

detecting, in an image density detecting means, a density of toner formed on the image bearing member;

correcting a toner concentration in the developer on the basis of a result of image density detection of a reference toner image formed on the image bearing member, the image density detection being performed by the image density detecting means; and executing a first toner concentration correction between printing operations and executing a second toner concentration correction between predetermined points during continuous printing;

wherein the first toner concentration correction includes applying a predetermined reference-toner-image formation bias voltage to the developer supplying member so as to form the reference toner image, the reference-toner-image formation bias voltage being a voltage for forming the reference toner image; and wherein the second toner concentration correction includes applying the reference-toner-image formation bias voltage and a correction bias voltage to the developer supplying member so as to form the reference toner image.

* * * * *